US011258212B2

(12) United States Patent
Iwamoto

(10) Patent No.: US 11,258,212 B2
(45) Date of Patent: Feb. 22, 2022

(54) GROUND TERMINAL AND CONNECTOR INCLUDING THE SAME

(71) Applicant: HOSIDEN CORPORATION, Yao (JP)

(72) Inventor: Yuta Iwamoto, Yao (JP)

(73) Assignee: Hosiden Corporation, Yao (JP)

( * ) Notice: Subject to any disclaimer, the term of this patent is extended or adjusted under 35 U.S.C. 154(b) by 0 days.

(21) Appl. No.: 17/097,382

(22) Filed: Nov. 13, 2020

(65) Prior Publication Data

US 2021/0167561 A1 Jun. 3, 2021

(30) Foreign Application Priority Data

Nov. 29, 2019 (JP) ..... JP2019-216055

(51) Int. Cl.

| | |
|---|---|
| ***H01R 13/648*** | (2006.01) |
| ***H01R 24/40*** | (2011.01) |
| ***H01R 13/11*** | (2006.01) |
| *H01R 103/00* | (2006.01) |

(52) U.S. Cl.

CPC ..... *H01R 24/40* (2013.01); *H01R 13/111* (2013.01); *H01R 2103/00* (2013.01)

(58) Field of Classification Search

CPC .. H01R 24/40; H01R 13/111; H01R 2103/00; H01R 13/6582; H01R 13/187; H01R 13/652; H01R 13/502

See application file for complete search history.

(56) References Cited

U.S. PATENT DOCUMENTS 3,453,587 A 7/1969 Neidecker
4,120,557 A * 10/1978 Horrocks ..... H01R 13/15 439/827
4,128,293 A * 12/1978 Paoli ..... H01R 13/187 439/843

(Continued)

FOREIGN PATENT DOCUMENTS

| | | |
|---|---|---|
| EP | 3 337 159 A1 | 6/2018 |
| JP | 2011-204607 A | 10/2011 |
| JP | 2018-098069 A | 6/2018 |

OTHER PUBLICATIONS

Extended European Search Report for European Patent Application No. 20204888.0, along with Communication, EPO Form 1703, Annex, and Search Strategy, dated Mar. 23, 2021 (10 pages).

*Primary Examiner* — Abdullah A Riyami
*Assistant Examiner* — Nelson R. Burgos-Guntin
(74) *Attorney, Agent, or Firm* — Kilyk & Bowersox, P.L.L.C.

(57) ABSTRACT

A ground terminal including a first ring of a C-shape or a ring shape and contact springs. The contact springs extend from the first ring in a first direction and are spaced from each other in a circumferential direction of the first ring. Each contact spring curves or bends such as to project to an inner side in a corresponding one of second directions. The first direction is an axial direction of the first ring. The second directions are substantially orthogonal to the first direction. The inner side in each second direction is a side nearer an axial center of the first ring. Each contact spring includes a first end portion on a side nearer the first ring, and a wide portion including at least an apex portion of the contact spring and having a width dimension that is larger than a width dimension of the first end portion.

22 Claims, 7 Drawing Sheets

(56) References Cited

U.S. PATENT DOCUMENTS 4,550,972 A * 11/1985 Romak ..... H01R 13/111 439/839
4,936,795 A * 6/1990 Kawai ..... H01R 13/655 439/607.19
5,653,615 A * 8/1997 Inaba ..... H01R 13/17 439/827
6,062,919 A * 5/2000 Trafton ..... H01R 13/187 439/843
7,387,548 B2 * 6/2008 Takehara ..... H01R 13/187 439/843
7,488,905 B2 * 2/2009 Kiely ..... H01R 13/745 174/650
8,079,885 B1 * 12/2011 Lin ..... H01R 13/111 439/851
8,784,143 B2 * 7/2014 Edgell ..... A61N 1/3752 439/843
9,601,856 B2 * 3/2017 Regantini ..... H01R 13/11
9,711,299 B2 * 7/2017 Cortinovis ..... H01H 9/02
10,535,958 B2 * 1/2020 Kondo ..... H01R 13/6596
2004/0003498 A1 * 1/2004 Swearingen ..... H01R 13/187 29/862
2004/0248475 A1 * 12/2004 Seminara ..... F42C 19/06 439/680
2007/0123084 A1 * 5/2007 Takehara ..... H01R 13/187 439/268
2007/0243760 A1 * 10/2007 Fujita ..... G01N 27/4071 439/585
2009/0197482 A1 * 8/2009 Mark ..... H01R 43/16 439/852
2010/0178799 A1 * 7/2010 Lee ..... H01R 9/0527 439/578
2012/0129374 A1 * 5/2012 Tu ..... H01H 1/385 439/312
2013/0109237 A1 * 5/2013 Glick ..... H01R 13/187 439/625
2014/0038473 A1 * 2/2014 Kojima ..... H01R 13/18 439/851
2014/0357137 A1 * 12/2014 Sian ..... H01R 13/187 439/843
2015/0024628 A1 * 1/2015 Haegele ..... H01R 9/0524 439/585
2015/0333419 A1 * 11/2015 Eriksen ..... H01R 13/502 439/578
2016/0322751 A1 * 11/2016 Van Swearingen .... H01R 13/64
2016/0344110 A1 * 11/2016 Sone ..... H01R 24/58
2018/0202509 A1 * 7/2018 Funke ..... F16F 9/532
2019/0006772 A1 * 1/2019 Nakazono ..... H01R 13/5224
2019/0006773 A1 * 1/2019 Hirakawa ..... H01R 4/48
2019/0006783 A1 * 1/2019 Nakazono ..... H01R 13/187
2019/0006795 A1 * 1/2019 Kondo ..... H01R 13/508
2019/0237894 A1 * 8/2019 Nakazono ..... H01R 13/432
2019/0252836 A1 * 8/2019 Watkins ..... H01R 24/40
2019/0305455 A1 10/2019 Uppleger
2020/0335886 A1 * 10/2020 Glueck ..... H01R 11/288
2021/0005995 A1 * 1/2021 Mangstl ..... H01R 13/052
2021/0167561 A1 * 6/2021 Iwamoto ..... H01R 13/111

* cited by examiner

GROUND TERMINAL AND CONNECTOR INCLUDING THE SAME

CROSS-REFERENCE TO RELATED APPLICATION

The present application claims priority under 35 U.S.C. § 119 of Japanese Patent Application No. 2019-216055 filed on Nov. 29, 2019, the disclosure of which is expressly incorporated by reference herein in its entirety.

BACKGROUND OF THE INVENTION

Technical Field

The invention relates to ground terminals and connectors including the same.

Background Art

Some conventional connectors are disclosed in Japanese Unexamined Patent Application Publication No. 2018-98069 (Literature 1) and No. 2011-204607 (Literature 2). Each of these connectors includes a metal shell, which includes a tube, and a ground terminal inside the tube of the shell. The ground terminal includes first and second rings to fit into the tube of the shell, and a plurality of contact springs connecting the first and second rings and curving to the inner side. When a mating connector is inserted into, or removed from, the tube of the shell and the ground terminal, the contact springs of the ground terminal make elastic contact with a shell of the mating connector.

SUMMARY OF INVENTION

Each contact spring of the ground terminal of Literature 1 is an elongated plate having a narrow width that is substantially consistent from the first ring to the second ring. Each contact spring of the ground terminal of Literature 2 is an elongated plate having a narrow width that decreases gradually from the first ring to a middle portion of the contact spring and increases gradually from the middle portion of the contact spring to the second ring. In either case, as the contact springs are narrow elongated plates, they are subjected to bending loads in a concentrated manner from the mating connector during the elastic contact, and such loads generate stresses in the contact springs in a concentrated manner.

The invention provides a ground terminal that allows distribution of loads applied to contact springs of the ground terminal. The invention also provides a connector including the ground terminal.

A ground terminal according to an aspect of the invention includes a first ring of a C-shape or a ring shape and a plurality of contact springs. The contact springs extend from the first ring in a first direction and are spaced from each other in a circumferential direction of the first ring. Each of the contact springs curves or bends such as to project to an inner side in a corresponding one of second directions. The first direction is an axial direction of the first ring. The second directions are substantially orthogonal to the first direction. The inner side in each second direction is a side nearer an axial center of the first ring. Each of the contact springs includes a first end portion on a side nearer the first ring, and a wide portion including at least an apex portion of the contact spring and having a width dimension that is larger than a width dimension of the first end portion.

When the ground terminal of this aspect receives a mating connector, the wide portion of each contact spring is pressed to the outer side in the corresponding second direction by the mating connector. The pressing thus applies a load on the wide portion of each contact spring, the load applied to each contact spring is distributed along the width direction of the wide portion.

Each of the contact springs may further include a second end portion on a side opposite to the first end portion. In this case, the wide portion of each contact spring may be located between the first end portion and the second end portion and include the apex portion of the contact spring. The width dimension of the wide portion of each contact spring may be larger than a width dimension of the second end portion.

The ground terminal may further include a second ring of a C-shape or a ring shape, and the second ring may be spaced from the first ring in the first direction. In this case, the contact springs may extend in the first direction from the first ring to the second ring.

The wide portion of each contact spring may include a first face on an outer side in the corresponding second direction, a second face on one side in a width direction of the wide portion, a third face on the other side in the width direction, a first corner where the first and second faces meet, and a second corner where the first and third faces meet.

The first and second corners of the wide portion of each contact spring may be of rectilinear shape extending in the first direction.

A connector according to an aspect of the invention includes an electrically conductive shell, the ground terminal of any of the above aspects, an insulative body, and at least one signal terminal.

The shell may include a tube and a housing in communication with the tube. The ground terminal may be housed in the tube of the shell. The body may be held by the housing of the shell. The at least one signal terminal may be held by the body.

Where the tube of the shell includes an inner wall in a shape of a circular section tube or a polygonal section tube that approximates to a circular section tube, and where the wide portion of each contact spring includes the first and second corners of any of the above aspects, in a state where each contact spring is elastically deformed to the outer side in the corresponding second direction, the first and second corners of the wide portion may be at least partly in abutment with the inner wall of the tube, and the first face of the wide portion may be located in spaced relation to the inner wall of the tube.

Where the first and second corners of the wide portion of each contact spring are of rectilinear shape extending rectilinearly in the first direction, in a state where each contact spring is elastically deformed to the outer side in the corresponding second direction, the first and second corners of the wide portion may be at least partly in abutment with the inner wall of the tube, and the first face of the wide portion may be located in spaced relation to the inner wall of the tube.

One of the ground terminal or the shell may include a first engaging protrusion, and the other one may include a first engaging recess to receive the first engaging protrusion.

One of the ground terminal or the body may include a second engaging protrusion, and the other one may include a second engaging recess to receive the second engaging protrusion.

Figure 1A:
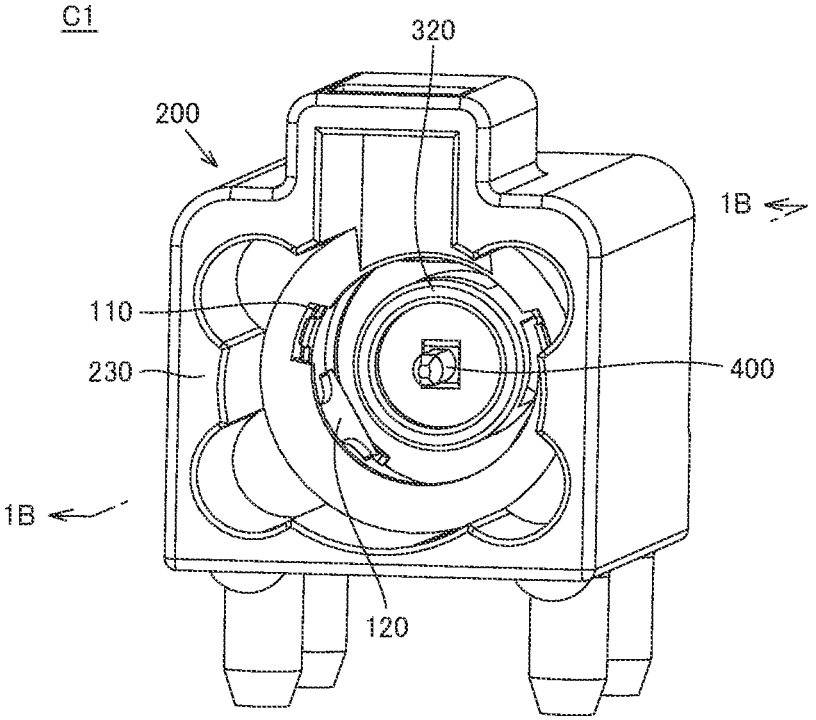
FIG. 1A is a front, top, right perspective view of a connector according to a first embodiment of the invention.
Figure 1B:
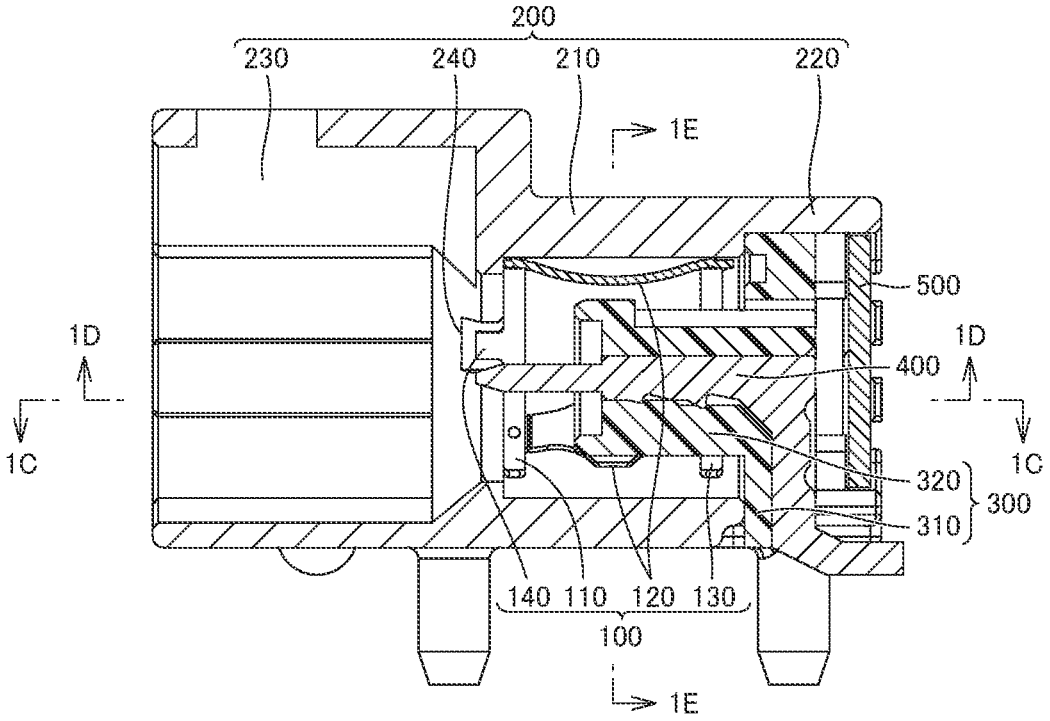
FIG. 1B is a cross-sectional view of the connector, taken along line 1B-1B of FIG. 1A.
Figure 1C:
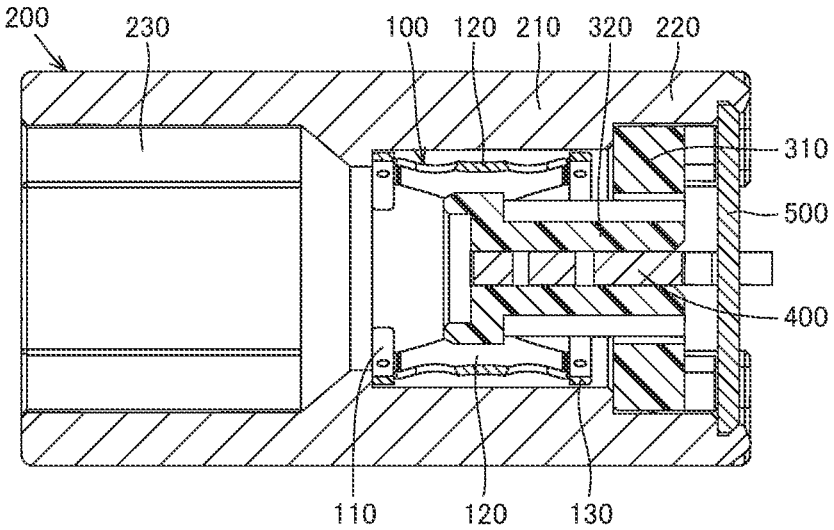
FIG. 1C is a cross-sectional view of the connector taken along line 1C-1C of FIG. 1B.
Figure 1D:
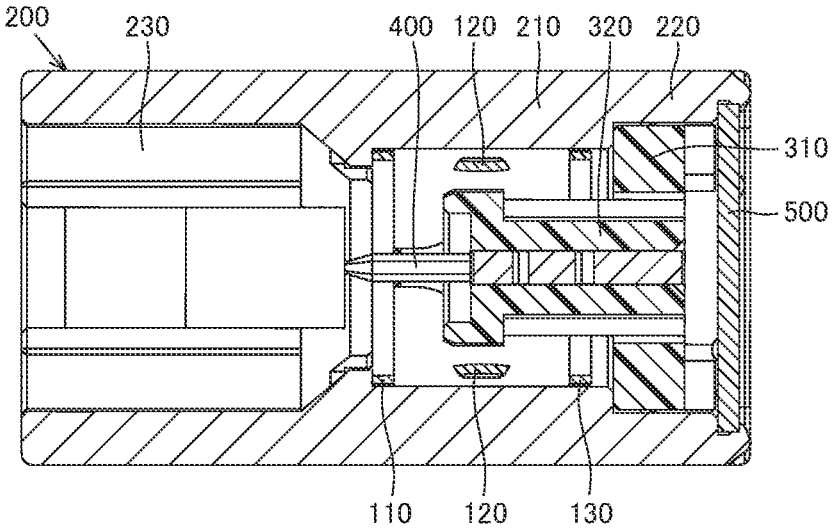
FIG. 1D is a cross-sectional view of the connector taken along line 1D-1D of FIG. 1B.

In the brief description of the drawings above and the description of embodiments which follows, relative spatial terms such as "upper", "lower", "top", "bottom", "left", "right", "front", "rear", etc., are used for the convenience of the skilled reader and refer to the orientation of the ground terminals and connectors and their constituent parts as depicted in the drawings. No limitation is intended by use of these terms, either in use of the invention, during its manufacture, shipment, custody, or sale, or during assembly of its constituent parts or when incorporated into or combined with other apparatus.

DESCRIPTION OF EMBODIMENTS

Various embodiments and their design variations of the invention will now be described. Constituents of the embodiments and the design variations to be described can be combined in any possible manner. Materials, shapes, dimensions, numbers, arrangements, etc. of the constituents in the embodiments and the design variations will be discussed below as examples only and can be modified as long as they achieve similar functions.

First Embodiment

The following is a description of a connector C1 according to various embodiments, including a first embodiment, and variations of the embodiments, of the invention with reference to FIGS. 1A to 2B. FIGS. 1A to 2B show the connector C1 according to the first embodiment.

The connector C1 includes a ground terminal 100. The ground terminal 100 includes a first ring 110. The first ring 110 is a metal plate of a C-shape or a ring shape. As used herein the term "C-shape" includes a circular ring shape that is partly cut away (see FIGS. 2A and 2B) and a polygonal ring shape that is partly cut away. As used herein the term "ring shape" includes a circular ring shape and a polygonal ring shape.

Figure 1E:
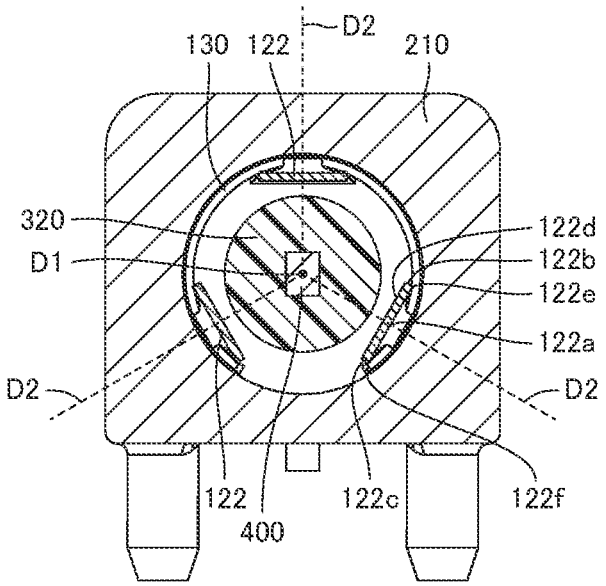
FIG. 1E is a cross-sectional view of the connector taken along line 1E-1E of FIG. 1B.
Figure 2A:
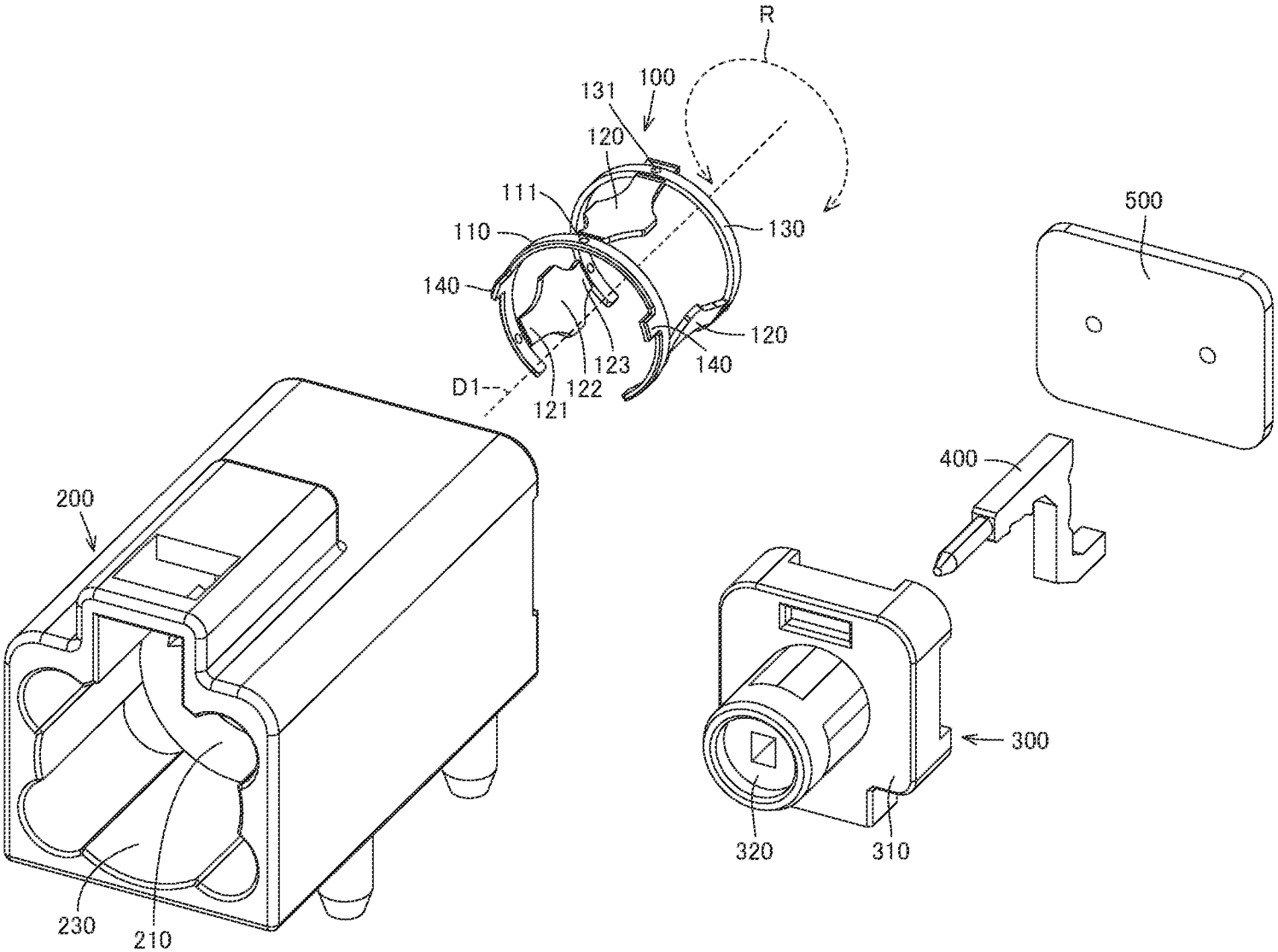
FIG. 2A is an exploded, front, top, right perspective view of the connector.
Figure 2B:
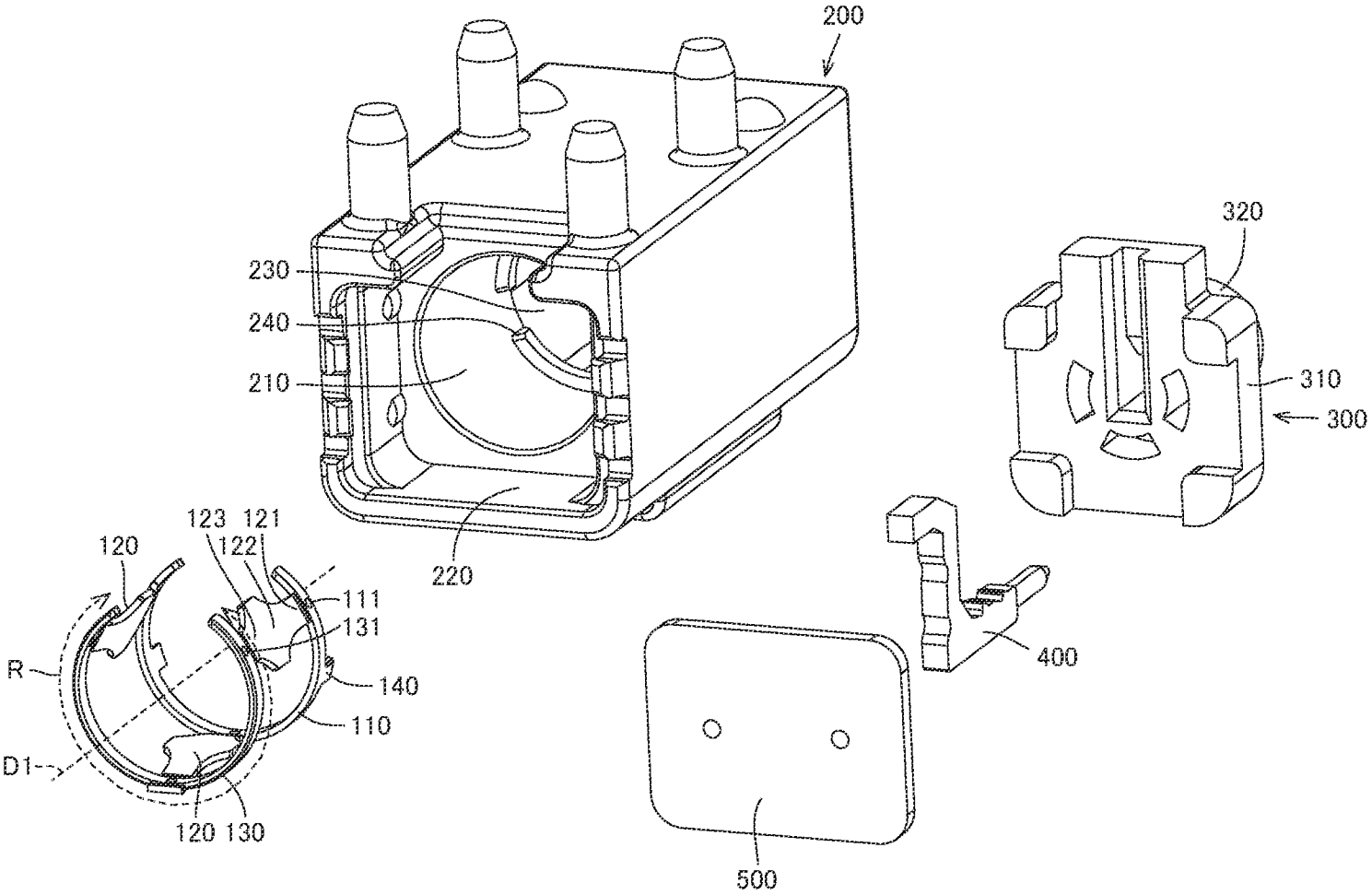
FIG. 2B is an exploded, rear, bottom, right perspective view of the connector.

FIGS. 2A and 2B indicates with broken lines a circumferential direction R of the first ring 110 and a first direction D1 being the axial direction of the first ring 110. A plurality of second directions D2 is substantially orthogonal to the first direction D1. FIG. 1E indicates the second directions D2 with broken lines, and these broken lines extend radially from the intersection with the broken lines indicating the first direction D1. Also, by "inner side" in each second direction D2 is meant the side nearer the axial center (the above intersection) of the first ring 110, and by "outer side" in each second direction D2 is meant the side opposite to the inner side.

The first ring 110 has an outer face and an inner face. The outer face of the first ring 110 may or may not be provided with a plurality of protrusions 111 arranged at spaced intervals along the circumferential direction R of the first ring 110.

The ground terminal 100 further includes a plurality of contact springs 120. Three or more contact springs 120 may be provided. The contact springs 120 are metal plates extending from the first ring 110 in the first direction D1, and are spaced from each other in the circumferential direction R. Each contact spring 120 curves or bends such as to project to the inner side in the corresponding second direction D2. For example, each contact spring 120 may curve such as to have a cross section of an arc shape projecting to the inner side in the corresponding second direction D2, or alternatively may bend such as to have a cross section of a V-shape or a trapezoidal shape projecting to the inner side in the corresponding second direction D2. Each contact spring 120 is elastically deformable to the outer side in the corresponding second direction D2. It should be appreciated that the "corresponding second direction D2" that corresponds to each contact spring 120 includes the curving or bending direction of the contact spring 120 (the inner side in the corresponding second direction D2) and the elastic deformation direction of the contact spring 120 (the outer side in the corresponding second direction D2). As used herein the "trapezoidal shape" is a shape consisting of a short base and a pair of legs of a trapezoid (as used in the US; trapezium in the UK) and does not include the long base of the trapezoid/trapezium.

Each contact spring 120 includes a first end portion 121 and a wide portion 122. The first end portion 121 is an end portion on a side of the contact spring 120 that is nearer the first ring 110, and is contiguous with the first ring 110. The wide portion 122 includes at least the apex portion of the contact spring 120.

Each contact spring 120 may further include a second end portion 123 on a side opposite to the first end portion 121. In this case, the wide portion 122 of each contact spring 120 is the apex portion of the contact spring 120, and has a width dimension that is larger than each of the width dimensions of the first end portion 121 and the second end portion 123 of the contact spring 120. The second end portion 123 can be omitted. Where the second end portion 123 is omitted, the wide portion 122 of each contact spring 120 may preferably include the apex portion of the contact spring 120 and an end portion on the side opposite to the first end portion 121, and have a width dimension that is be larger than the width dimension of the first end portion 121 of the contact spring 120.

The wide portion 122 of each contact spring 120 may be a polygonal plate (a generally octagonal plate in FIGS. 1A to 2B), or alternatively a generally circular plate. In any of these aspects, the wide portion 122 of each contact spring 120 has a first face 122*a* on the outer side in the corresponding second direction D2, a second face 122*b* on one side in the width direction of the wide portion 122, a third face 122*c* on the other side in the width direction, a fourth face 122*d* opposite to the first face 122*a*, a first corner 122*e* where the first face 122*a* and the second face 122*b* meet, and a second corner 122*f* where the first face 122*a* and the third face 122*c* meet.

Where the wide portion 122 of each contact spring 120 is polygonal, the second face 122*b* and the third face 122*c* may be flat faces extending in the first direction D1 (see FIG. 2). Alternatively, the second face 122*b* may have a generally V-shape projecting to one side in the width direction when viewed from the outer side in the corresponding second direction D2, and the third face 122*c* may have a generally V-shape projecting to the other side in the width direction when viewed from the outer side in the corresponding second direction D2. In the former case, the first corner 122*e* and the second corner 122*f* each have a rectilinear shape extending in the first direction D1. In the latter case, the first corner 122*e* has a generally V-shape projecting to one side in the width direction when viewed from the outer side in the corresponding second direction D2, and the second corner 122*f* has a generally V-shape projecting to the other side in the width direction when viewed from the outer side in the corresponding second direction D2.

Where the wide portion 122 of each contact spring 120 is generally circular, the second face 122*b* may have a generally arc shape projecting to one side in the width direction when viewed from the outer side in the corresponding second direction D2, and the third face 122*c* may have a generally arc shape projecting to the other side in the width direction when viewed from the outer side in the corresponding second direction D2. In this case, the first corner 122*e* has a generally arc shape projecting to one side in the width direction when viewed from the outer side in the corresponding second direction D2, and the second corner 122*f* has a generally arc shape projecting to the other side in the width direction when viewed from the outer side in the corresponding second direction D2.

The ground terminal 100 may further include a second ring 130. The second ring 130 is a metal plate of a C-shape or a ring shape, arranged on one side in the first direction D1 relative to, and in spaced relation to, the first ring 110. The second ring 130 may preferably, but is not required to, have the same outer size as, or similar outer size to, the first ring 110. The second ring 130 may preferably, but is not required to, have the same inner size as, or similar inner size to, the first ring 110. The axial center of the second ring 130 may or may not coincide with the axial center of the first ring 110. Irrespective of how the second ring 130 is configured, the contact springs 120 extend in the first direction D1 from the first ring 110 to the second ring 130. The second end portions 123 of the contact springs 120 are contiguous with the second ring 130.

The second ring 130 has an outer face and an inner face. The outer face of the second ring 130 may or may not be provided with a plurality of protrusions 131 arranged at spaced intervals along the circumferential direction R. The second ring 130 may be omitted.

The connector C1 further includes an electrically conductive shell 200. The shell 200 may be made of a cast metal, may be made of a pressed metal plate, or may be made of a metal prepared by 3D printing. Alternatively, the shell 200 may be made of a metal vapor-deposited on an outer face and/or an inner face of a shell body of molded plastic material. In any of the aspects, the shell 200 includes a tube 210 extending in the first direction D1. The tube 210 has an inner wall, which may be in a shape of a circular section tube or in a shape of a polygonal section tube that approximates to a circular section tube. As used herein the term "in a shape of a polygonal section tube that approximates to a circular section tube" means that the polygonal section tube looks like a generally circular section tube when simplified with the details of the shape disregarded. The tube 210 houses the ground terminal 100 of any of the above aspects. For example, where the second ring 130 is not provided, the tube 210, the first ring 110, and the plurality of contact springs 120 may further have the following configuration (a) or (b). Where the second ring 130 is provided, the tube 210, the first ring 110, the plurality of contact springs 120, and the second ring 130 may further have the following configuration (c) or (d).

(a) The first ring 110 is of a C-shape. The inner wall of the tube 210 has an inner shape of a circular- or polygonal-section tube that conforms to the outer shape of the first ring 110, and has an inner size that is smaller than the outer size of the first ring 110. The first ring 110 is configured to contract (elastically deform) such that the outer size thereof becomes smaller than the inner size of the tube 210, inserted in this state into the tube 210, and then released to restore itself to be housed in the tube 210 together with the contact springs 120. Where the first ring 110 is not provided with the protrusions 111, the outer face of the first ring 110 is in elastic contact with the inner wall of the tube 210. Where the first ring 110 is provided with the protrusions 111, the protrusions 111 are in elastic contact with the inner wall of the tube 210.

(b) The first ring 110 is of a ring shape. The inner wall of the tube 210 has an inner shape of a circular- or polygonal-section tube that conforms to the outer shape of the first ring 110, and has an inner size that is substantially the same as the outer size of the first ring 110. The first ring 110 is housed in the tube 210 together with the contact springs 120. Where the first ring 110 is not provided with the protrusions 111, the outer face of the first ring 110 is in abutment with the inner wall of the tube 210. Where the first ring 110 is provided with the protrusions 111, the protrusions 111 are in abutment with the inner wall of the tube 210.

(c) The first ring 110 and the second ring 130 have respective outer shapes of an identical C-shape or similar C-shapes, and have respective outer sizes that are the same or similar to each other. The inner wall of the tube 210 has an inner shape of a circular- or polygonal-section tube that conforms to the outer shape of the first ring 110 and/or that of the second ring 130, and has an inner size that is smaller than the outer size of each of the first ring 110 and the second ring 130. The first ring 110 and the second ring 130 are configured to contract (elastically deform) such that each of the outer sizes thereof becomes smaller than the inner size of the tube 210, inserted in this state into the tube 210, and then released to restore themselves to be housed in the tube 210 together with the contact springs 120. Where the first ring 110 is not provided with the protrusions 111, the outer face of the first ring 110 is in elastic contact with the inner wall of the tube 210. Where the first ring 110 is provided with the protrusions 111, the protrusions 111 are in elastic contact with the inner wall of the tube 210. Where the second ring 130 is not provided with the protrusions 131, the outer face of the second ring 130 is in elastic contact with the inner wall of the tube 210. Where the second ring 130 is provided with the protrusions 131, the protrusions 131 are in elastic contact with the inner wall of the tube 210.

(d) The first ring 110 and the second ring 130 have respective outer shapes of an identical ring shape or similar ring shapes, and have respective outer sizes that are the same or similar to each other. The inner wall of the tube 210 has an inner shape of a circular- or polygonal-section tube that conforms to the outer shape of the first ring 110 and/or that of the second ring 130, and has an inner size that the same as each of the outer sizes of the first ring 110 and the second ring 130. The first ring 110 and the second ring 130 are housed in the tube 210 together with the contact springs 120. Where the first ring 110 is not provided with the protrusions 111, the outer face of the first ring 110 is in abutment with the inner wall of the tube 210. Where the first ring 110 is provided with the protrusions 111, the protrusions 111 are in abutment with the inner wall of the tube 210. Where the second ring 130 is not provided with the protrusions 131, the outer face of the second ring 130 is in abutment with the inner wall of the tube 210. Where the second ring 130 is provided with the protrusions 131, the protrusions 131 are in abutment with the inner wall of the tube 210.

Where the ground terminal 100 has the configuration (a) or (b), the first ring 110 may be housed in the tube 210 of the shell 200 such that the ground terminal 100 is movable along the first direction D1 relative to the tube 210 of the shell 200, or alternatively such that the ground terminal 100 is fixed in the first direction D1 to the tube 210. For example, the ground terminal 100 may fixed in the first direction D1 to the tube 210 with the first ring 110 of the configuration (b) fitting in the tube 210 of the shell 200. Where the ground terminal 100 has the configuration (c) or (d), the first ring 110 and the second ring 130 may be housed in the tube 210 of the shell 200 such that the ground terminal 100 is movable along the first direction D1 relative to the tube 210 of the shell 200, or alternatively such that the ground terminal 100 is fixed in the first direction D1 to the tube 210. For example, the ground terminal 100 may fixed in the first direction D1 to the tube 210 with the first ring 110 and/or the second ring 130 of the configuration (d) fitting in the tube 210 of the shell 200.

The shell 200 further includes a housing 220. The housing 220 is provided on the one side in the first direction D1 relative to the tube 210. The housing 220 has an inner space in communication with the tube 210. The inner space of the housing 220 may open at least to one side in the first direction D1. The inner space of the housing 220 may open also to the lower side in a height direction (as shown in the drawings) of the connector C1. The height direction may preferably be orthogonal to the first direction D1.

The shell 200 may further include a guide 230. For example, the guide 230 may be provided on the other side in the first direction D1 relative to the tube 210, so as to guide a mating connector C2 into the tube 210. For example, the guide 230 may preferably be of a tubular shape extending from the tube 210 to the other side in the first direction D1 and open to the other side in the first direction D1. The guide 230 may have at least one key groove extending in the first direction D1.

Whether or not the guide 230 is provided, it may be through or via the housing 220 that the tube 210 houses the first ring 110 and the contact springs 120 of the ground terminal 100 in a manner as described for configuration (a) or (b) above, or alternatively houses the first ring 110, the contact springs 120, and the second ring 130 of the ground terminal 100 in a manner as described for configuration (c) or (d) above.

Where the guide 230 is provided, it may be through or via the guide 230 that the tube 210 houses the first ring 110 and the contact springs 120 of the ground terminal 100 in a manner as described for configuration (a) or (b) above, or alternatively houses the first ring 110, the contact springs 120, and the second ring 130 of the ground terminal 100 in a manner as described for configuration (c) or (d) above.

Where the guide 230 is not provided, it may be from the other side in the first direction D1 that the tube 210 houses the first ring 110 and the contact springs 120 of the ground terminal 100 in a manner as described for configuration (a) or (b) above, or alternatively houses the first ring 110, the contact springs 120, and the second ring 130 of the ground terminal 100 in a manner as described for configuration (c) or (d) above.

Where the tube 210 has any of the configurations (a) to (d) above and the inner wall thereof is in a shape of a circular section tube or a polygonal section tube that approximates to a circular section tube, the contact springs 120 may be arranged as follows. In a state where each contact spring 120 is elastically deformed to the outer side in the corresponding second direction D2 (this state may be hereinafter referred to simply as an "elastically deformed state" of the contact spring 120), the first corner 122*e* and the second corner 122*f*, of any of the above aspects, of the wide portion 122 may be at least partly in abutment with the inner wall of the tube 210, and the first face 122*a* of the wide portion 122 may be located in spaced relation to the inner wall of the tube 210 in the corresponding second direction D2.

Where the first corner 122*e* and the second corner 122*f* of the wide portion 122 of each contact spring 120 is rectilinear as described above, with each contact spring 120 being in the elastically deformed state, the first corner 122*e* and the second corner 122*f* of the contact spring 120 may be partly or entirely (at least partly) in abutment with the inner wall of the tube 210. Where the first corner 122*e* and the second corner 122*f* of the wide portion 122 of each contact spring 120 is generally V-shaped or arc shaped as described above, the first corner 122*e* and the second corner 122*f* of the contact spring 120 may be partly in abutment with the inner wall of the tube 210.

With increasing the width dimension of each wide portion 122, decreased is the distance from the first corner 122*e* of the wide portion 122, and the distance from the second corner 122*f* of the wide portion 122, to the inner wall of the tube 210 in the corresponding second direction D2 in the state before each contact spring 120 elastically deforms, and accordingly reduced is the maximum amount of displacement of the wide portion 122 when each contact spring 120 has elastically deformed. With decreasing the width dimension of each wide portion 122, increased is the distance from the first corner 122*e* of the wide portion 122, and the distance from the second corner 122*f* of the wide portion 122, to the inner wall of the tube 210 in the corresponding second direction D2 in the state before each contact spring 120 elastically deforms, and accordingly raised is the maximum amount of displacement of the wide portion 122 when each contact spring 120 has elastically deformed. As such, it is preferable to determine the appropriate width dimension of each wide portion 122 in view of the maximum amount of displacement of the wide portion 122.

It is also possible to arrange the tube 210 and the contact springs 120 such that in a state where each contact springs 120 is elastically deformed to the outer side in the corresponding second direction D2, the first corner 122*e* and the second corner 122*f* of the wide portion 122 are not in abutment, in the corresponding second direction D2, with the inner wall of the tube 210 of any of the aspects.

The connector C1 further includes a body 300. The body 300 may be made of an insulating resin and may be held by, and housed in, the housing 220 of the shell 200. For example, the body 300 may include a base 310 and a projection 320. The base 310 is held by, and housed in, the housing 220 of the shell 200. The projection 320 extends from the base 310 such as to project to the other side in the first direction D1. The projection 320 has an outer size that is smaller than the size of an inside space defined by the contact springs 120. The projection 320 is located within the inside space. The projection 320 may be omitted.

The connector C1 further includes at least one signal terminal 400 held by the body 300. The or each signal terminal 400 includes a contact portion, a middle portion, and a tail portion. In the or each signal terminal 400, the middle portion may be of generally L-shape, the contact portion may extend from one end of the middle portion in the first direction D1, the tail portion may extend from the other end of the middle portion to the one side in the first direction D1 (see FIG. 1A to FIG. 2B). Alternatively, the or each signal terminal 400 may be of generally L-shape, the middle portion may be of generally L-shape, the contact portion may extend from one end of the middle portion in the first direction D1, and the tail portion may extend from the other end of the middle portion rectilinearly in the height direction. Still alternatively, the or each signal terminal 400 may be of generally rectilinear shape extending in the first direction D1. The contact portion of the or each signal terminal 400 projects from, or are exposed from, the body 300 and is located within the inside space. The tail portion of the or each signal terminal 400 projects from, or are exposed from, the body 300 and is located outside the shell 200 or inside the housing 220 of the shell 200. The tail portion of the or each signal terminal 400 is connectable to a core of a cable or to a circuit board.

One of the ground terminal 100 or the shell 200 may further include at least one first engaging protrusion 140, and the other one may further include at least one first engaging recess 240. For example, the at least one first engaging protrusion 140 and the at least one first engaging recess 240 may have one of the following configurations (A) to (D).

(A) The first engaging protrusion or protrusions 140 may extend from the first ring 110 to the other side in the first direction D1. The first engaging recess or recesses 240 may be provided in an inner portion of the shell 200 and located on the other side in the first direction D1 relative to the first ring 110, and may be recessed to the other side in the first direction D1. The first engaging protrusion or protrusions 140 may be received in the corresponding first engaging recess or recesses 240 from the one side in the first direction D1.

(B) The first engaging protrusion or protrusions 140 may extend to the one side in the first direction D1 from an inner portion of the shell 200 and be located on the other side in the first direction D1 relative to the first ring 110. The first engaging recess or recesses 240 may be provided at the first ring 110, and may be recessed to the one side in the first direction D1. The first engaging protrusion or protrusions 140 may be received in the corresponding first engaging recess or recesses 240 from the other side in the first direction D1.

(C) The first engaging protrusion or protrusions 140 may extend from the first ring 110 and/or the second ring 130 to the outer side in the corresponding second direction or directions D2 (in other words, the or each first engaging protrusion 140 may extend from the first ring 110 or the second ring 130 to the outer side in the corresponding second direction D2). The first engaging recess or recesses 240 may be provided in an inner portion of the shell 200 and located on the outer side in the corresponding second direction or directions D2 relative to the first ring 110 and/or the second ring 130, and may be recessed to the outer side in the corresponding second direction or directions D2 (in other words, the or each engaging recess 240 may be provided in the inner portion of the shell 200 and located on the outer side in the corresponding second direction D2 relative to the first ring 110 or the second ring 130, and may be recessed to the outer side in the corresponding second direction D2). The first engaging protrusion or protrusions 140 may be received in the corresponding first engaging recess or recesses 240 from the outer side in the corresponding second direction D2.

(D) The first engaging protrusion or protrusions 140 may extend to the inner side in the corresponding second direction or directions D2 from an inner portion of the shell 200 and be located on the outer side in the corresponding second direction or directions D2 relative to the first ring 110 and/or the second ring 130 (in other words, the or each first engaging protrusion 140 may extend to the inner side in the corresponding second direction D2 from the inner portion of the shell 200 and be located on the outer side in the corresponding second direction D2 relative to the first ring 110 or the second ring 130). The first engaging recess or recesses 240 may be provided at the first ring 110 and/or the second ring 130 and recessed to the inner side in the corresponding second direction or directions D2 (in other words, the or each engaging recess 240 may be provided at the first ring 110 or the second ring 130 and recessed to the inner side in the corresponding second direction D2). The first engaging protrusion or protrusions 140 may be received in the corresponding first engaging recess or recesses 240 from the inner side in the corresponding second direction or directions D2.

In the case of (A) or (B) above, where the ground terminal 100 is movable along the first direction D1 relative to the shell 200, the first engaging protrusion or protrusions 140 may be received in the corresponding first engaging recess or recesses 240 such as to be movable along the first direction D1. In the case of (C) or (D) above, where the ground terminal 100 is movable along the first direction D1 relative to the shell 200, the first engaging recess or recesses 240 may be of elongated shape extending in the first direction D1.

One of the ground terminal 100 or the body 300 may further include at least one second engaging protrusion (not illustrated), and the other may further include at least one second engaging recess (not illustrated). For example, the at least one second engaging protrusion and the at least one second engaging recess may have the following configuration (E) or (F).

(E) The second engaging protrusion or protrusions may extend from the second ring 130 to the one side in the first direction D1. The second engaging recess or recesses may be provided at portions of the body 300 that are located on the one side in the first direction D1 relative to the second ring 130, and may be recessed to the one side in the first direction D1. The second engaging protrusion or protrusions are received in the corresponding second engaging recess or recesses from the other side in the first direction D1.

(F) The second engaging protrusion or protrusions may extend to the other side in the first direction D1 from the portions of the body 300 that are located on the one side in the first direction D1 relative to the second ring 130. The second engaging recess or recesses may be provided at the second ring 130, and may be recessed to the other side in the first direction D1. The second engaging protrusion or protrusions are received in the corresponding second engaging recess or recesses from the one side in the first direction D1.

In case (E) or (F), where the ground terminal 100 is movable along the first direction D1 relative to the shell 200, the second engaging protrusion or protrusions may be received in the corresponding second engaging recess or recesses such as to be movable along the first direction D1.

Where the ground terminal 100 is fixed to the shell 200 such as not to be movable along the first direction D1, the first engaging protrusion or protrusions 140 may be fittingly received in the corresponding first engaging recess or recesses 240 in any of cases (A) to (D), and/or the second engaging protrusion or protrusions may be fittingly received in the corresponding second engaging recess or recesses in case (E) or (F). It is possible to omit the first engaging protrusions 140 and the first engaging recesses 240, and/or to omit the second engaging protrusion and the second engaging recesses.

The connector C1 may further include a cover 500. The cover 500 is a metal plate to cover the body 300, which is housed in the inner space of the housing 220, from the one side in the first direction D1. The cover 500 may be omitted.

Figure 3A:
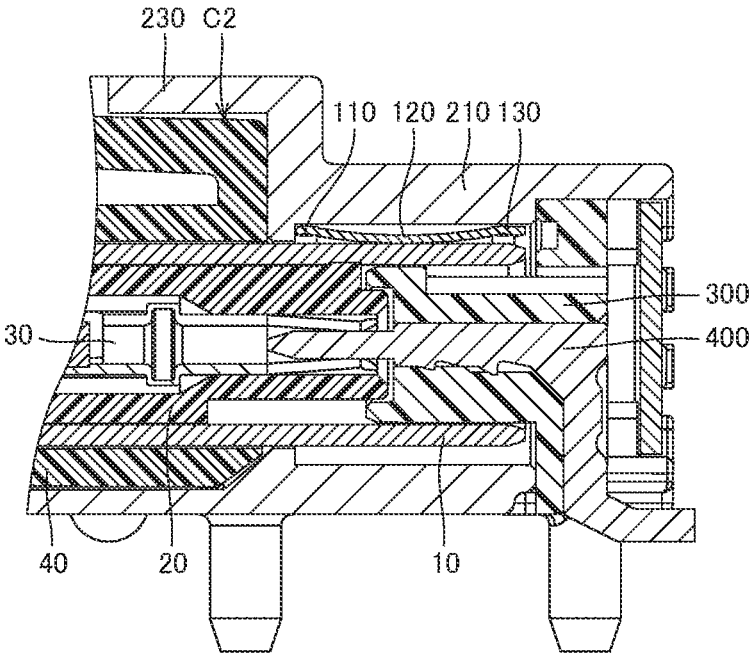
FIG. 3A is a partial cross-sectional view, corresponding to FIG. 1B, of the connector and a mating connector connected thereto.
Figure 3B:
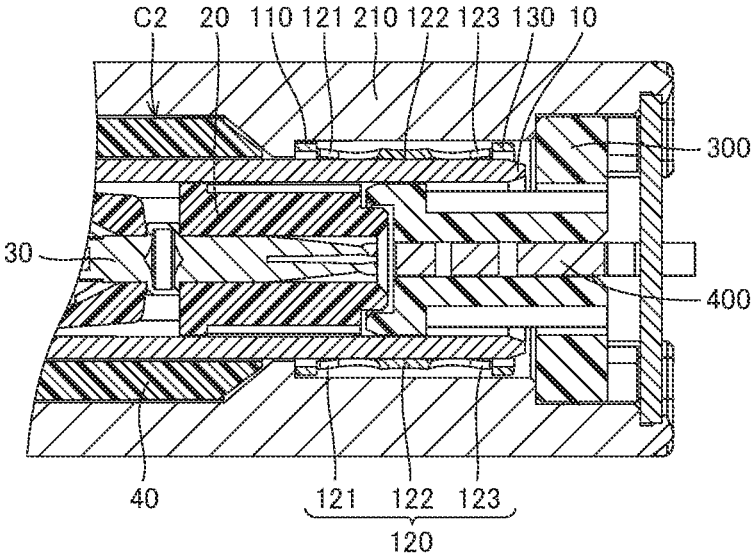
FIG. 3B is a partial cross-sectional view, corresponding to FIG. 1C, of the connector and the mating connector connected thereto.

The connector C1 having any of the configurations described above is connectable to a mating connector C2. The mating connector C2 may be configured as described below and as shown in FIGS. 3A and 3B. FIGS. 3A and 3B shows a state where the connector C1 according to the first embodiment is connected to the mating connector C2.

The mating connector C2 includes an electrically conductive shell 10 of tubular shape, an inner body 20 made of an insulating resin, and at least one terminal 30. The shell 10 is a circular section tube or a polygonal section tube. The shell 10 has an outer size, particularly a dimension of a cross section in the height direction (the height direction of the connector C1), that is larger than a dimension of a cross section in the height direction of a space defined by the wide portions 122 of the contact springs 120 of the ground terminal 100 of the connector C1, and that is smaller than an inner dimension of a cross section in the height direction of the first ring 110. The inner body 20 is held in the shell 10, and at least one terminal 30 is held by the inner body 20 and located inside the shell 10. The mating connector C2 may further include an outer body 40 made of an insulating resin. The outer body 40 may preferably surround a portion of the shell 10 that exclude the distal portion thereof. In other words, the distal portion of the shell 10 protrude from the outer body 40. The outer body 40 may preferably include at least one key conforming to the at least one key groove of the guide 230 of the shell 200.

Figure 4A:
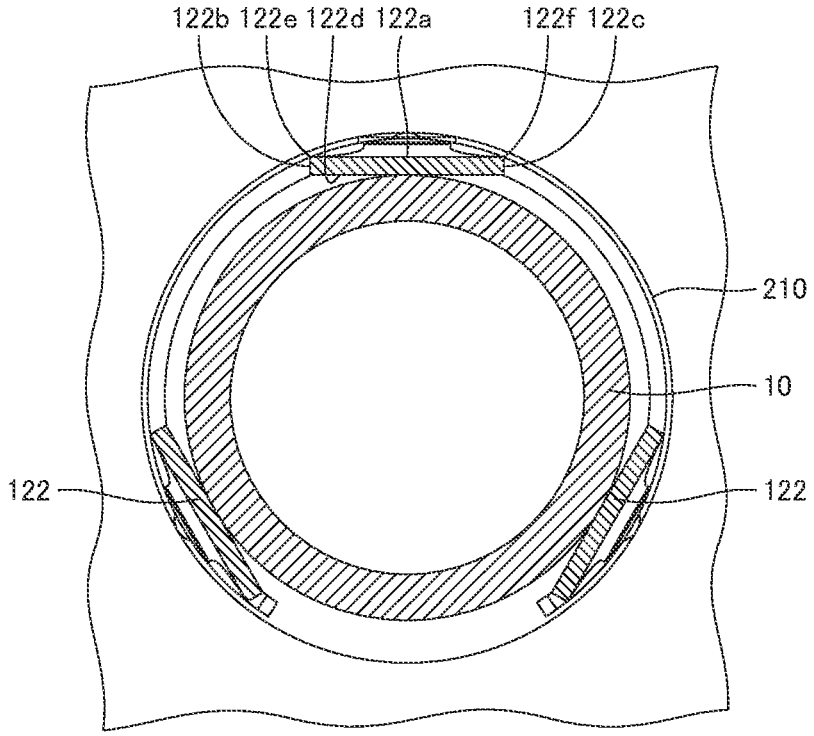
FIG. 4A is a schematic enlarged cross-sectional view, corresponding to FIG. 1E, of the connector and the mating connector connected thereto, wherein the mating connector is received in a tube of a shell of the connector.

Now described is a method of connecting the connector C1 to the mating connector C2 in a proper state, with reference to FIGS. 3A to 4A. FIG. 4A shows a positional relationship between the connector C1 and the shell 10 of the mating connector C2 when the mating connector C2 is received in the connector C1 in the proper state.

When the distal portion of the shell 10 of the mating connector C2 is properly received into the space defined by all the contact springs 120 (i.e. into the above inside space) inside the tube 210 of the shell 200 of the connector C1—for example, as shown in FIGS. 3A to 4A, when the distal portion of the shell 10 of the mating connector C2 is correctly received into the space defined by all the contact springs 120 (i.e. into the above inside space) inside the tube 210 of the shell 200 of the connector C1 such that the axial center of the shell 10 of the mating connector C2 coincides in the first direction D1 with the axial center of the tube 210 of the shell 200 of the connector C1—the distal portion of the or each one terminal 30 of the mating connector C2 comes into contact with the contact portion of the or a respective signal terminal 400 of the connector C1, and the wide portions 122 of the contact springs 120 are substantially equally pressed onto the distal portion of the shell 10. As a result, the contact springs 120 elastically deform to the outer side in the corresponding second directions D2 substantially equally, and make elastic contact with the distal portion of the shell 10 substantially equally. Thus, the distal portion of the or each one terminal 30 of the mating connector C2 is electrically connected to the or a respective signal terminal 400 of the connector C1, and the shell 10 of the mating connector C2 is electrically connected to the shell 200 of the connector C1 via the ground terminal 100. This is how the connector C1 is connected to the mating connector C2.

Figure 4B:
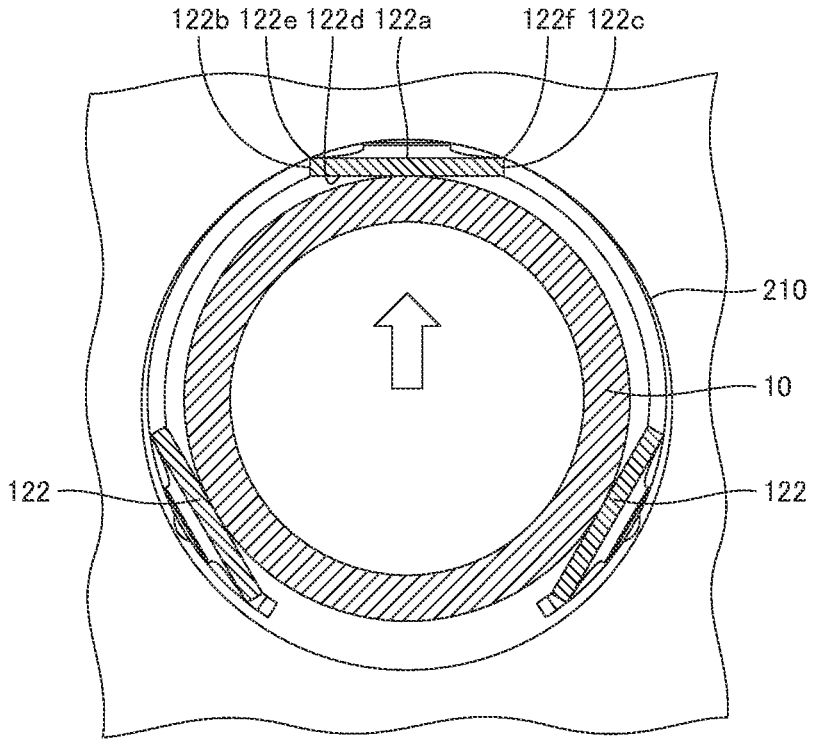
FIG. 4B is a schematic enlarged cross-sectional view, corresponding to FIG. 1E, of the connector and the mating connector connected thereto, wherein the mating connector in displaced or tilted state is received in the tube of the shell of the connector.

Now described is a method of connecting the connector C1 to the mating connector C2 in an improper state, with reference to FIG. 4B. FIG. 4B shows a positional relationship between the connector C1 and the shell 10 of the mating connector C2 when the mating connector C2 is received into the connector C1 in the improper state (displaced or tilted in a second direction D2 during the connection). For the convenience in description, all of the plurality of second directions D2 may be referred to as "all the second directions D2," one of all the second directions D2 may be referred to as "one second direction," more than one of all the second directions D2 may be referred to as "more than one second directions," and the remaining one or ones of all the second directions D2 may be referred to as a "remaining second direction or directions." It should be noted that the "more than one second directions" is not "(all of) the plurality of second directions D2;" the "remaining second directions D2" excluding the "one second direction D2" is a plurality of second directions D2; and the "remaining second direction or directions D2" excluding the "more than one second directions D2" is one or more second directions D2. All of the plurality of contact springs 120 may be referred to as "all the contact springs 120," one of all the contact springs 120 may be referred to as "one contact spring 120," more than one of all the contact springs 120 may be referred to as "more than one contact springs 120," and the remaining one or ones of all the contact springs 120 may be referred to as a "remaining contact spring or springs 120." It should be noted that the "more than one contact springs 120" is not all the contact springs 120; the "remaining contact springs 120" excluding the "one contact spring 120" is a plurality of contact springs 120; and the "remaining contact spring or springs 120" excluding the "more than contact springs 120" is one or more contact springs 120.

In a state where the shell 10 of the mating connector C2 is displaced or tilted to the outer side in one second direction D2, when the distal portion of the shell 10 of the mating connector C2 is received into the space defined by all the contact springs 120 (i.e. into the above inside space) inside the tube 210 of the shell 200 of the connector C1 (see FIG. 4B), the distal portion of the or each one terminal 30 of the mating connector C2 comes into contact with the contact portion of the or a respective signal terminal 400 of the connector C1, and the fourth face 122*d* of the wide portion 122 of one contact spring 120 positioned on the outer side in the one second direction D2 relative to the distal portion of the shell 10 is pressed with a load larger than the load on the fourth face(s) 122*d* of the wide portion(s) 122 of the remaining contact spring or springs 120 positioned on the outer side in the remaining second direction or directions D2. Thus, the one contact spring 120 elastically deforms to the outer side in the one second direction D2 to a larger degree than the remaining contact spring or springs 120, and the one contact spring 120 makes elastic contact with the distal portion of the shell 10 to the outer side in the one second direction D2 with a load larger than that the remaining contact spring or springs 120. The urging force of the one contact spring 120 pushes the distal portion of the shell 10 back to the inner side in the one second direction D2, resulting in that all the contact springs 120 are substantially equally in elastic contact with the distal portion of the shell 10. This is how the connector C1 is connected to the mating connector C2.

If the one contact spring 120 elastically deforms to the outer side in the one second direction D2 to a larger degree than the remaining contact spring or springs 120 as described above, the first corner 122*e* and the second corner 122*f* of any of the above aspects of the wide portion 122 of the one contact spring 120 may at least partly come into abutment with the inner wall of the tube 210, and the first face 122*a* of the wide portion 122 may be disposed in spaced relation to the inner wall in one second direction D2. In this case, the one contact spring 120 elastically deforms only within a predetermined limited amount.

In a state where the shell 10 of the mating connector C2 is displaced or tilted to the outer side in more than one second directions D2, when the distal portion of the shell 10 of the mating connector C2 is received into the space defined by all the contact springs 120 (i.e. into the above inside space) inside the tube 210 of the shell 200 of the connector C1 (see FIG. 4B), the distal portion of the or each one terminal 30 of the mating connector C2 comes into contact with the contact portion of the or a respective signal terminal 400 of the connector C1, and the fourth faces 122*d* of the wide portions 122 of more than one contact springs 120 positioned on the outer side in the more than one second directions D2 relative to the distal portion of the shell 10 are pressed with a load larger than the load on the fourth face(s) 122*d* of the wide portion(s) 122 of the remaining contact spring or springs 120 positioned on the outer side in the remaining second direction or directions D2. Thus, the more than one contact springs 120 elastically deform to the outer side in the more than one second directions D2 to a larger degree than the remaining contact spring or springs 120, and the more than one contact springs 120 come into elastic contact with the distal portion of the shell 10 to the outer side in the more than one second directions D2 with a load larger than that the remaining contact spring or springs 120. The urging forces of the more than one contact springs 120 push the distal portion of the shell 10 back to the inner side in the more than one second directions D2, resulting in that all the contact springs 120 are substantially equally in elastic contact with the distal portion of the shell 10. This is how the connector C1 is connected to the mating connector C2.

If the more than one contact springs 120 are elastically deformed to the outer side in the more than one second directions D2 to a larger degree than the remaining contact spring or springs 120 as described above, the first corners 122*e* and the second corners 122*f* of any of the above aspects of the wide portions 122 of the more than one contact springs 120 may at least partly come into abutment with the inner wall of the tube 210, and the first faces 122*a* of the wide portions 122 may be disposed in spaced relation to the inner wall in the more than one second directions D2. In this case, the more than one contact springs 120 elastically deform only within a predetermined limited amount.

The connector C1 described above provides the following technical features and effects.

Technical Feature and Effect (1)

When the connector C1 is connected to the mating connector C2, the wide portions 122 of the contact springs 120 of the connector C1 are pressed to the outer side in the corresponding second directions D2 by the shell 10 of the mating connector C2. This pressing applies loads to the wide portions 122, the loads to be applied to the contact springs 120 are distributed in the width directions of the wide portions 122. As a result, stresses generated in the contact springs 120 in accordance with the loads are also distributed in the width direction of the wide portions 122.

Technical Feature and Effect (2)

The connector C1 provides improved electromagnetic compatibility (EMC) characteristics. Particularly, the shell 200 of the connector C1 can be electrically connected stably to the shell 10 of the mating connector C2 via the ground terminal 100 because the wide portions 122 of the contact springs 120 of the connector C1 come into elastic contact with the shell 10 of the mating connector C2. This arrangement improves the EMC characteristics of the connector C1 and those of the mating connector C2. Where the shell 200 of the connector C1 is made of a metal prepared by casting or 3D printing, the shell 200 can be prepared without slits or openings, except for an opening for connecting the mating connector C2 and an opening for leading out the tail portion of the or each signal terminal 400 or a cable to be connected to the tail portion. This arrangement further improves the EMC characteristics of the connector C1.

Technical Feature and Effect (3)

It is possible to restrict elastic deformation of each contact spring 120 to a predetermined amount in a case where, in the elastically deformed state of each contact spring 120, the first corner 122*e* and the second corner 122*f* of any one of the above aspects of the wide portion 122 are at least partly in abutment with the inner wall of the tube 210, and the first face 122*a* of the wide portion 122 is located in spaced relation to the inner wall in the corresponding second direction D2. In this case, the first corner 122*e* and the second corner 122*f* can come into abutment with the inner wall of the tube 210 so as to restrict elastic deformation of each contact spring 120. Further, where the first corner 122*e* and the second corner 122*f* are rectilinear, they are more stable in the above abutment.

Technical Feature and Effect (4)

It is possible to further stabilize the electrical connection between the shell 200 of the connector C1 and the shell 10 of the mating connector C2 in a case where the connector C1 is provided with the at least one first engaging protrusion 140 and the at least one first engaging recess 240 and/or the at least one second engaging protrusion and the at least one second engaging recess. In this case, the at least one first engaging protrusion 140 is receivable into the at least one first engaging recess 240 and/or the at least one second engaging protrusion is receivable into the at least one second engaging recess, thereby preventing the ground terminal 100 from rotating in the circumferential direction R inside the tube 210 of the shell 200.

The ground terminal and the connector described above are not limited to the above embodiments and may be modified in any manner within the scope of the claims.

The first direction of the invention is only required to be the axial direction of the first ring of the ground terminal of the invention. The second direction of the invention is any direction substantially orthogonal to the first direction.

REFERENCE SIGNS LIST

| | |
|---|---|
| C1: | connector |
| 100: | ground terminal |
| 110: | first ring |
| 111: | protrusion |
| 120: | contact spring |
| 121: | First end portion |
| 122: | wide portion (122a: first face, 122b: second face, 122c: third face 122d: fourth face, 122e: first corner, 122f: second corner) |
| 123: | second end portion |
| 130: | second ring |
| 131: | protrusion |
| 140: | first engaging protrusion |
| 200: | shell |
| 210: | tube |
| 220: | housing |
| 230: | guide |
| 240: | first engaging recess |
| 300: | body |
| 310: | base |
| 320: | projection |
| 400: | signal terminal |
| 500: | cover |
| C2: | mating connector |
| D1: | first direction |
| D2: | second direction |
| R: | circumferential direction |

What is claimed is:

1. A ground terminal comprising:

a first ring of a C-shape or a ring shape; and a plurality of contact springs extending from the first ring in a first direction and being spaced from each other in a circumferential direction of the first ring, each of the contact springs curving or bending such as to project to an inner side in a corresponding one of second directions, where the first direction is an axial direction of the first ring, the second directions are substantially orthogonal to the first direction, and the inner side in each second direction is a side nearer an axial center of the first ring, each of the contact springs including a first end portion on a side nearer the first ring, and a wide portion including at least an apex portion of the contact spring and having a width dimension in a width direction, which is larger than a width dimension in the width direction, of the first end portion, wherein the width direction of the wide portion of each contact spring extends substantially orthogonally relative to the corresponding second direction.

2. The ground terminal according to claim 1, wherein each of the contact springs further includes a second end portion on a side opposite to the first end portion, and the wide portion of each contact spring is located between the first end portion and the second end portion, and the width dimension of the wide portion of each contact spring is larger than a width dimension of the second end portion.

3. The ground terminal according to claim 1, further comprising a second ring of a C-shape or a ring shape, the second ring being spaced from the first ring in the first direction, wherein the contact springs extend in the first direction from the first ring to the second ring.

4. The ground terminal according to claim 2, further comprising a second ring of a C-shape or a ring shape, the second ring being spaced from the first ring in the first direction, wherein the contact springs extend in the first direction from the first ring to the second ring.

5. The ground terminal according to claim 1, wherein the wide portion of each contact spring includes:

a first face on an outer side in the corresponding second direction, a second face on one side in the width direction of the wide portion, a third face on the other side in the width direction, a first corner where the first and second faces meet, and a second corner where the first and third faces meet, and the first and second corners of the wide portion of each contact spring are of rectilinear shape extending rectilinearly in the first direction.

6. The ground terminal according to claim 1, wherein the wide portion of each contact spring includes:

a first face on an outer side in the corresponding second direction, a second face on one side in the width direction of the wide portion, a third face on the other side in the width direction, a first corner where the first and second faces meet, and a second corner where the first and third faces meet, and the first corner of the wide portion of each contact spring has a generally V-shape or generally arc shape projecting to one side in the width direction when viewed from the outer side in the corresponding second direction, and the second corner of the wide portion of each contact spring has a generally V-shape or generally arc shape projecting to the other side in the width direction when viewed from the outer side in the corresponding second direction.

7. A connector comprising:

an electrically conductive shell including a tube and a housing in communication with the tube;

the ground terminal according to claim 1, the ground terminal being housed in the tube of the shell;

an insulative body held by the housing of the shell; and at least one signal terminal held by the body.

8. A connector comprising:

an electrically conductive shell including a tube and a housing in communication with the tube;

the ground terminal according to claim 2, the ground terminal being housed in the tube of the shell;

an insulative body held by the housing of the shell; and at least one signal terminal held by the body.

9. A connector comprising:

an electrically conductive shell including a tube and a housing in communication with the tube;

the ground terminal according to claim 3, the ground terminal being housed in the tube of the shell;

an insulative body held by the housing of the shell; and at least one signal terminal held by the body.

10. The connector according to claim 7, wherein the tube includes an inner wall in a shape of a circular section tube or a polygonal section tube that approximates to a circular section tube, the wide portion of each contact spring includes:

a first face on an outer side in the corresponding second direction, a second face on one side in the width direction of the wide portion, a third face on the other side in the width direction, a first corner where the first and second faces meet, and a second corner where the first and third faces meet, and in a state where each contact spring is elastically deformed to the outer side in the corresponding second direction, the first and second corners of the wide portion are at least partly in abutment with the inner wall of the tube, and the first face of the wide portion is located in spaced relation to the inner wall of the tube.

11. The connector according to claim 8, wherein the tube includes an inner wall in a shape of a circular section tube or a polygonal section tube that approximates to a circular section tube, the wide portion of each contact spring includes:

a first face on an outer side in the corresponding second direction, a second face on one side in the width direction of the wide portion, a third face on the other side in the width direction, a first corner where the first and second faces meet, and a second corner where the first and third faces meet, and in a state where each contact spring is elastically deformed to the outer side in the corresponding second direction, the first and second corners of the wide portion are at least partly in abutment with the inner wall of the tube, and the first face of the wide portion is located in spaced relation to the inner wall of the tube.

12. The connector according to claim 9, wherein the tube includes an inner wall in a shape of a circular section tube or a polygonal section tube that approximates to a circular section tube, the wide portion of each contact spring includes:

a first face on an outer side in the corresponding second direction, a second face on one side in the width direction of the wide portion, a third face on the other side in the width direction, a first corner where the first and second faces meet, and a second corner where the first and third faces meet, and in a state where each contact spring is elastically deformed to the outer side in the corresponding second direction, the first and second corners of the wide portion are at least partly in abutment with the inner wall of the tube, and the first face of the wide portion is located in spaced relation to the inner wall of the tube.

13. The connector according to claim 10, wherein the first and second corners of the wide portion of each contact spring are of rectilinear shape extending rectilinearly in the first direction, and in a state where each contact spring is elastically deformed to the outer side in the corresponding second direction, the first and second corners of the wide portions are at least partly in abutment with the inner wall of the tube, and the first face of the wide portion is located in spaced relation to the inner wall of the tube.

14. The connector according to claim 11, wherein the first and second corners of the wide portion of each contact spring are of rectilinear shape extending rectilinearly in the first direction, and in a state where each contact spring is elastically deformed to the outer side in the corresponding second direction, the first and second corners of the wide portions are at least partly in abutment with the inner wall of the tube, and the first face of the wide portion is located in spaced relation to the inner wall of the tube.

15. The connector according to claim 12, wherein the first and second corners of the wide portion of each contact spring are of rectilinear shape extending rectilinearly in the first direction, and in a state where each contact spring is elastically deformed to the outer side in the corresponding second direction, the first and second corners of the wide portions are at least partly in abutment with the inner wall of the tube, and the first face of the wide portion is located in spaced relation to the inner wall of the tube.

16. The connector according to claim 10, wherein one of the ground terminal or the shell includes a first engaging protrusion, and the other one includes a first engaging recess to receive the first engaging protrusion.

17. The connector according to claim 13, wherein one of the ground terminal or the shell includes a first engaging protrusion, and the other one includes a first engaging recess to receive the first engaging protrusion.

18. The connector according to claim 10, wherein one of the ground terminal or the body includes a second engaging protrusion, and the other one includes a second engaging recess to receive the second engaging protrusion.

19. The connector according to claim 13, wherein one of the ground terminal or the body includes a second engaging protrusion, and the other one includes a second engaging recess to receive the second engaging protrusion.

20. The connector according to claim 16, wherein one of the ground terminal or the body includes a second engaging protrusion, and the other one includes a second engaging recess to receive the second engaging protrusion.

21. The ground terminal according to claim 1, wherein the width direction of the wide portion of each contact spring extends substantially orthogonally relative to the first direction.

22. The connector according to claim 10, wherein the width direction of the wide portion of each contact spring extends substantially orthogonally relative to the first direction.

* * * * *